United States Patent [19]

Stumpf

[11] 3,964,187

[45] June 22, 1976

[54] ADJUSTABLE COIN DISPLAY DEVICE

[75] Inventor: Elmer J. Stumpf, Los Angeles, Calif.

[73] Assignee: Beemak Plastics, Los Angeles, Calif.

[22] Filed: May 16, 1975

[21] Appl. No.: 578,022

[52] U.S. Cl. ..... 40/27.5; 40/1.5; 40/2 A

[51] Int. Cl.[2] ..... G09F 3/02

[58] Field of Search ..... 40/1.5, 2 A, 27.5, 155, 40/152, 10; 206/.81, .82, .8

[56] References Cited

UNITED STATES PATENTS

| | | | |
|---|---|---|---|
| 1,528,475 | 3/1925 | Gaunt | 40/1.5 |
| 2,358,262 | 9/1944 | Suess | 206/.81 |
| 2,511,651 | 6/1950 | Schultz | 40/2 A |

*Primary Examiner*—Louis G. Mancene
*Assistant Examiner*—Wenceslao J. Contreras
*Attorney, Agent, or Firm*—Huebner & Worrel

[57] ABSTRACT

An adjustable coin display device for receiving a coin wherein the structure grips the periphery of the coin and both sides of the coin may be viewed without an overlay to cause a visual obstruction of the coin faces. The device is adjustable to accommodate coins of varying diameter and includes a circular member designed to engage and grip the peripheral edge of a coin and eye means secured to the circular member for suspension of the entire device and coin.

4 Claims, 6 Drawing Figures

ADJUSTABLE COIN DISPLAY DEVICE

BACKGROUND OF THE INVENTION

With the advent of the United States Centennial celebration various commemorative coins will be struck by government entities and other organizations wherein both faces of the coins are artistic and the need for displaying these coins so that both sides of the coin may be displayed is apparent.

Applicant is not aware of any type of structure whereby a coin may be mounted and in turn suspended so that both sides of the coin may be observed wherein the face portions are free of an overlay. Prior art devices have included the mounting of a coin between pieces of plastic which must be gripped by the fingers in order to turn the coin around for viewing. Additionally there have been coin mounts of the type including cardboard sheets having openings whereby the coin may be placed into the opening. These devices have the disadvantage of not allowing the opposite face of the coin to be viewed without taking the coin out and turning it over. In certain instances it is not desirable to finger a coin particularly those which are identified as in "mint condition." In view of oils that are on the fingers, smudges and discoloration of the coins is possible which in turn can detract from the appearance as well as reduce the monetary value of the coin.

SUMMARY OF THE INVENTION

The adjustable coin display device of this invention is of such a nature as to be preferably formed of clear plastic and is adapted to grip the peripheral edge of a coin leaving the faces exposed for viewing. Additionally the device includes means whereby the coin may be suspended from a structure for display. Such a device will enhance the value of a coin and will make its display much more attractive.

In view of the fact that many commemorative coins will be struck within the next several years commemorating the American Centennial celebration and in view of the fact that not all coins are of the same diameter and usually vary between 5 to 6 mm. in diameter it is desirable to have a coin display device which is adjustable and can be adapted to retain coins of varying diameters within some general limitations.

The device includes a split ring with an interior groove to receive a coin and maintain it in position. Secured to the split ring and bridging the split is an eye through which a hook may be placed whereby the coin may be suspended from a structure for viewing or alternately the eye may be used as a finger hold so that the coin may be inspected at close range without the necessity of touching the coin with the fingers. The structure will also allow the viewer to see either face of the coin without distortion, because no overlay material covers the faces of the coin.

Further objects and advantages of the invention may be brought out in the following part of the specification wherein small details have been described for the competence of disclosure without intending to limit the scope of the invention which is set forth in the appended claims.

DETAILED DESCRIPTION OF THE PREFERRED EMBODIMENTS

Figure 1:
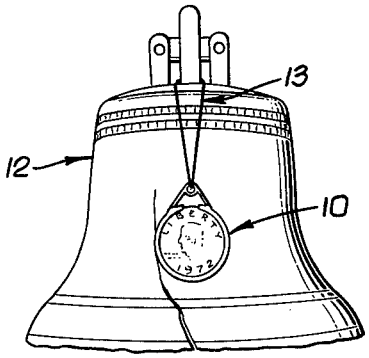
FIG. 1 is an environmental view of an adjustable coin display device of this invention suspended within a clear glass or plastic cover.

There is illustrated in the drawings an adjustable coin display device generally designated 10. In FIG. 1 the coin display device 10 is shown in an environment where it can be suspended within a clear glass or plastic structure 12 such as a replica of the Liberty Bell in Philadelphia or other glass domes. In this case, there is provided an attaching means 13 suspending from the top of the cover 12 which is adapted to engage the display device 10 so that it is suspended within the cover 12. Any type of attaching means 13 such as wire, thread, etc., may be used.

The adjustable coin display device 10 includes a flexible split ring 14 preferably made from clear plastic which has a memory and can return to its original diameter. As can be seen the split is formed at the top of the ring 14 and when molded or otherwise formed the ends 16 and 18 of the ring 14 are preferably slightly spaced one from the other forming the split. The ring 14 includes an outer smooth edge 20 and the interior of the ring 14 is formed with a coin receiving means or an annular groove 22 wherein annular edge beads 24 and 26 define the groove 22. The area between the respective beads 24 and 26 is preferably greater than the thickness of a coin.

Secured to the split ring 14 and bridging the split formed by the ends 16 and 18 are suspension means generally designated 27. The suspension means 27 preferably includes a pair of arms 28 and 30 which are molded with the ring 14 in a single operation or otherwise secured to the ring 14. The arms 28 and 30 extend upwardly from split ring 14 and inwardly toward each other terminating in an eye 32. In view of the fact that the arms 28 and 30 must be flexible and give with the flexing of the ring 14 they are preferably of a diameter less than the diameter of the split ring 14 and of plastic.

Figure 2:
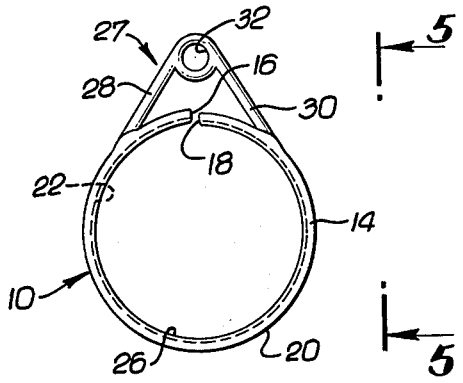
FIG. 2 is an enlarged side elevational view of the adjustable coin display device without a coin in place.
Figure 3:
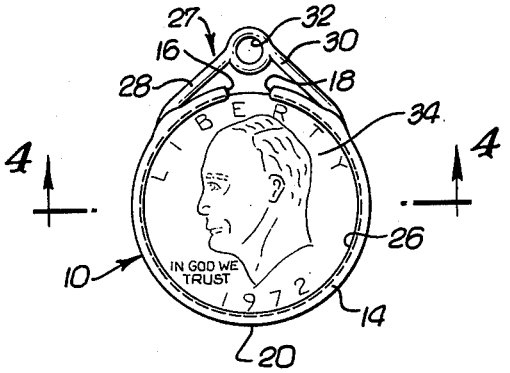
FIG. 3 is a view similar to FIG. 2 illustrating a coin mounted within the device.
Figure 4:
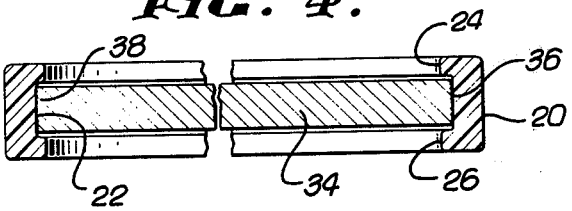
FIG. 4 is an enlarged cross sectional view taken on line 4—4 of FIG. 3.
Figure 5:
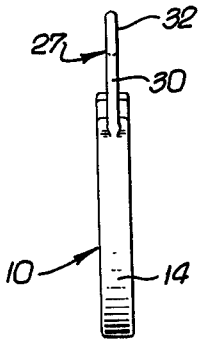
FIG. 5 is a side elevational view of the device taken on lines 5—5 of FIG. 2.
Figure 6:
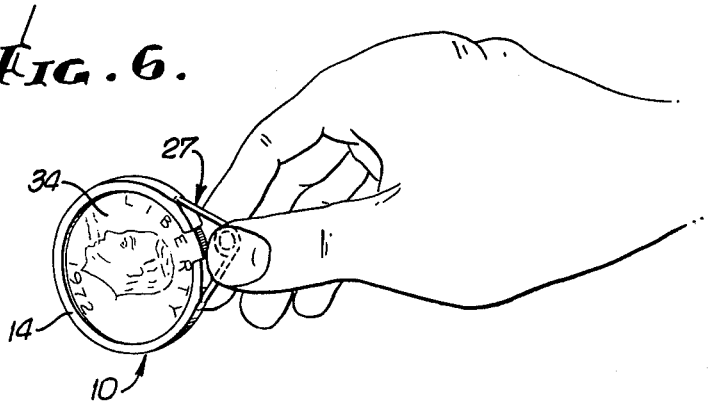
FIG. 6 is a second environmental view of the coin display device wherein it is being gripped by fingers for close visual observation.

In order to mount a coin 34 within the split ring 14 the ring is flexed outwardly where the split or space between the ends 16 and 18 is enlarged and the coin 34 is placed within the groove 22 and the split ring is then allowed to return to a position such as shown in FIGS. 1, 2 and 6. It will be noted that due to the construction of the device 10, it can be flexed within limitations to receive coins 34 of varying diameters and still maintain peripheral contact with the coin. As can be seen the coin 34 will remain fixed in the groove 22 in position and it is relatively difficult to dislodge the coin from the ring 14. Additionally, some coins 34 are formed with "graining" or "milling" 36 on the peripheral edge 38 and thus they can "bite" into the groove 22 which further assures a fixed position of the coin 34 within the device 10.

Once the coin 34 has been properly seated within the groove 22 the eye 32 may then be suspended by the attaching means 13 within the transparent cover 12 or may be suspended from other means not illustrated. In the alternative should it be desired that the coin 34 be available for closer visual inspection the suspension means 27 may be gripped by fingers such as shown in FIG. 6 whereby the coin may be turned to see one side or the other for close examination.

While it is assumed that the Centennial commemorative coins will vary between 5 and 6 mm and one device 10 will suffice should it be desired to prepare this particular device for use with other coins or medallions the diameter of the adjustable coin display device 10 may be varied to accommodate such coins.

It can thus be seen that by utilizing a plastic which is flexible and has a memory there will be a peripheral gripping of the edge 38 of the coin 34 and yet the gripping will not damage the coin.

Although I have herein shown and described my invention in what I have conceived to be the most practical and preferred embodiment, it is recognized that departures may be made therefrom within the scope of my invention.

I claim:

1. An adjustable coin display device comprising an annular split ring having a set diameter yet yieldable to an enlarged annular diameter, said ring including an annular coin receiving means adapted to engage the peripheral edge of a coin; a suspension means extending from said annular split ring whereby said last means may be engaged to suspend said device so that both faces of said coin may be viewed, said annular split ring including spaced apart aligned ends when in said set diameter position and when said ring is yieldable to an enlarged annular, diameter position, said suspension means bridging said aligned ends of said split ring.

2. An adjustable coin display device as defined in claim 1 wherein said annular coin receiving means includes an annular groove of a width sufficient to accept the thickness of a coin.

3. An adjustable coin display device comprising an annular split ring having a set diameter yet yieldable to an enlarged annular diameter, said ring including an annular coin receiving means adapted to engage the peripheral edge of a coin; a suspension means extending from said annular split ring whereby said last means may be engaged to suspend said device so that both faces of said coin may be viewed, said annular split ring including spaced apart aligned ends when in said set diameter position and when said ring is yieldable to an enlarged annular, diameter position, said suspension means bridging said aligned ends of said split ring and including pair of flexible arms extending from said split ring angularly toward each other and terminating in an eyelet.

4. An adjustable coin display device as defined in claim 3 wherein said annular coin receiving means includes an annular groove of a width sufficient to accept the thickness of a coin.

* * * * *